United States Patent [19]

Ogasawara et al.

[11] Patent Number: 4,657,605

[45] Date of Patent: Apr. 14, 1987

[54] FINE AMORPHOUS METAL WIRES

[75] Inventors: Isamu Ogasawara; Kiyotsugu Maekawa; Hiroyuki Tomioka; Shinji Furukawa, all of Kyoto, Japan

[73] Assignee: Unitika Ltd., Hyogo, Japan

[21] Appl. No.: 889,973

[22] Filed: Jul. 28, 1986

[30] Foreign Application Priority Data

Jul. 26, 1985 [JP] Japan ..... 60-166559

[51] Int. Cl.[4] ..... H01F 1/04

[52] U.S. Cl. ..... 148/304; 148/403; 148/425; 420/435

[58] Field of Search ..... 148/403, 425, 31.55; 420/435

[56] References Cited

U.S. PATENT DOCUMENTS

| | | | |
|---|---|---|---|
| 4,439,253 | 3/1984 | Ramanan | 148/403 |
| 4,473,417 | 9/1984 | Inomata et al. | 148/403 |
| 4,523,626 | 7/1985 | Masumoto et al. | 164/463 |
| 4,527,614 | 7/1985 | Masumoto et al. | 164/463 |
| 4,566,917 | 1/1986 | O'Handley | 148/31.55 |

FOREIGN PATENT DOCUMENTS 0050479 4/1982 European Pat. Off. .

*Primary Examiner*—John P. Sheehan

*Attorney, Agent, or Firm*—Sughrue, Mion, Zinn, Macpeak & Seas

[57] ABSTRACT

A fine amorphous metallic wire having a circular cross section and stability to a bias magnetic field, said wire being composed of an alloy having the following composition formula $$(Co_{1-a}Fe_a)_{100-x-y-z}Si_xB_yMn_z$$

wherein $x<20$ atomic %, 7 atomic $\% \leqq y<35$ atomic %, 7 atomic $\% < x+y \leqq 35$ atomic %, 0.1 atomic $\% \leqq z \leqq 3$ atomic %, and $0.01 \leqq a \leqq 0.1$. The fine amorphous metallic wire has low magnetostriction, high magnetic permeability, high saturation magnetic flux density, and excellent toughness, and is stable against a bias magnetic field. Hence, it can be used as a material for electromagnetic devices such as a coordinate reading device, a current sensor, an eddy current sensor, a magnetic sensor, or a displacement sensor.

12 Claims, No Drawings

FINE AMORPHOUS METAL WIRES

FIELD OF THE INVENTION

This invention relates to fine amorphous metallic wires which are circular in cross section and have stable properties against a bias magnetic field while retaining the excellent properties of Co-type amorphous alloys such as low magnetostriction, high magnetic permeability, and high saturation magnetic flux density.

BACKGROUND OF THE INVENTION

Amorphous magnetic alloy materials have been extensively studied for commercialization because of their excellent electromagnetic properties. Particularly, Co-Fe-Si-B type amorphous alloys of specific compositions can achieve very low magnetostriction, and are very much expected to find applications as materials for magnetic heads, magnetic sensors, etc. Attempts have been actively made to improve their electromagnetic properties such as magnetic permeability and magnetic flux density by adding various elements to the Co-Fe-Si-B type amorphous alloys. For example, Japanese Patent Application (OPI) No. 102541/81 (The term "OPI" as used herein refers to a "published unexamined Japanese patent application".) discloses that Mn is added to the above type alloy so as to make its crystallization temperature above the Curie point, and the Mn-containing alloy is heat-treated above the Curie point in an attempt to improve its electromagnetic properties. This patent document states that it has previously been known to improve the electromagnetic properties of a conventional amorphous alloy by heat-treating it above the Curie point (usually 300° to 400° C.) and cooling the heat-treated product; but that a Co-Fe-Si-B type amorphous alloy crystallizes during heat-treatment because its Curie point is higher than its crystallization temperature. However, it is described that by adding a suitable amount (0.5 to 10 atomic%) of Mn to the alloy, the Curie point is made lower than the crystallization temperature, and consequently, this alloy can be heat-treated and thus improved in electromagnetic properties.

Japanese Patent Application (OPI) No. 79052/82 (corresponding to U.S. Pat. No. 4,527,614 and European Pat. No. 50,479) discloses high-quality Co-type fine amorphous metallic wires circular in cross section which have a very uniform shape with a circularity of at least 90% and a diameter variation of not more than 4%.

An amorphous metallic ribbon produced by the one roll method by the present inventors from a conventional Co-type amorphous metal, for example, an alloy having the composition of Co-Fe-Si-B-Mn described in the above-cited Japanese Patent Application (OPI) No. 102541/81 had low magnetostriction, high magnetic permeability, and high saturation magnetic flux density, but when a bias magnetic field was applied to it, its magnetic permeability decreased abruptly. Specifically, a Co-Fe-Si-B-Mn type amorphous metallic ribbon having a thickness of about from 5 to 100 microns (μm) and a width of from 2 to 100 mm produced by jetting a molten alloy of the Co-Fe-Si-B-Mn type onto a rotating cooling roll made of a material having high thermal conductivity such as copper markedly decreases in magnetic permeability under the influence of a bias magnetic field.

Such ribbon which decreases in magnetic permeability in a bias magnetic field cannot be used in practical applications because when it is applied, for example, to a coordinates reading device, signals obtained become abruptly weak due to even a slight bias magnetic field, for example by the influence of the earth's magnetism owing to the differences in the directions of east, west, south, and north, or by the influence of a magnetized body near the measuring instrument.

The Co-type fine amorphous metallic wires described in Japanese Patent Application (OPI) No. 79052/82 have superior electromagnetic properties and corrosion resistance, but their magnetic permeability decreases under the influence of a bias magnetic field. Hence, they are not fully acceptable as a material for a coordinates reading device, for example.

SUMMARY OF THE INVENTION

One object of this invention is to provide an amorphous electromagnetic alloy material which is substantially invulnerable to influences of a bias magnetic field while retaining the low magnetostriction, high magnetic permeability, and high saturation magnetic flux density characteristics of Co-type amorphous alloy.

The present inventors have made extensive investigations in order to achieve this object, and have found that fine amorphous metallic wires having substantial invulnerability to a bias magnetic field can be obtained by adding a specific amount of Mn to an alloy of Co, Fe, Si, and B in specific proportions, and processing the resulting alloy such that the resulting wires have a circular cross section.

According to this invention, there is provided a fine amorphous metallic wire having a circular cross section and stability to a bias magnetic field, said wire being composed of an alloy having the composition formula $$(Co_{1-a}Fe_a)_{100-x-y-z}Si_xB_yMn_z$$

wherein $x<20$ atomic%, 7 atomic% $\leqq y<35$ atomic%, 7 atomic% $<x+y\leqq 35$ atomic%, 0.1 atomic% $\leqq z\leqq 3$ atomic%, and $0.01\leqq a\leqq 0.1$.

The fine amorphous metallic wire has low magnetostriction, high magnetic permeability, high saturation magnetic flux density, and excellent toughness, and is stable to a bias magnetic field. Hence, it is very useful as a material for electromagnetic devices such as coordinates reading devices, current sensors, eddy current sensors, magnetic sensors, displacement sensors, etc., to which the application of conventional Co-type amorphous alloys is difficult.

DETAILED DESCRIPTION OF THE PREFERRED EMBODIMENTS

The fine amorphous metallic wire of this invention is a material having low magnetostriction, high magnetic permeability, high saturation magnetic flux density, substantial invulnerability to influences of a bias magnetic field, and excellent toughness. To obtain these properties, the composition of the alloy should be limited as described below.

The total sum of Si and B should exceed 7 atomic% but not be more than 35 atomic%, and preferably is at least 15 atomic% but not more than 32 atomic%. If the total of Si and B is 7 atomic% or less, or more than 35 atomic%, an amorphous single phase fine metallic wire cannot be obtained, and the resulting fine metallic wire has poor toughness, which creates serious problems in after-processing. This is not industrially desirable.

Within the above specified total amount of Si and B, the proportion of Si should be less than 20 atomic%, and preferably is at least 7.5 atomic% but not more than 17.5 atomic%. If the proportion of Si is 20 atomic% or above, an amorphous single phase fine metallic wire cannot be obtained, and the resulting metallic wire has poor toughness.

Likewise, the proportion of B should be at least 7 atomic% but less than 35 atomic%, and preferably is at least 7.5 atomic% but not more than 25 atomic%. If the proportion of B is less than 7 atomic% or at least 35 atomic%, the resulting metallic wire has poor toughness.

Taking the total of Co and Fe as 1, the proportion of Fe should be at least 0.01 but not more than 0.1. If the proportion of Fe exceeds 0.1, the magnetostriction increases on the positive side. If the proportion of Fe is less than 0.01, the magnetostriction increases on the negative side.

The proportion of Mn should be at least 0.1 atomic% but not more than 3 atomic%, preferably is at least 0.25 atomic% but not more than 2 atomic%, and more preferably is at least 0.4 atomic% but not more than 1.4 atomic%. If the proportion of Mn exceeds 3 atomic%, the toughness of the resulting metallic wire is much reduced and the wire becomes brittle and useless in practical applications. If it is less than 0.1 atomic%, no effect due to adding Mn is observed, and the magnetic permeability of the resulting metallic wire is greatly reduced by the influence of a bias magnetic field. The fine metallic wire of this invention may contain impurities in amounts present in ordinary industrial materials.

To produce the fine wire of this invention, the above alloy can be melted and quenched and solidified by a spinning method in a rotating liquid, which is particularly preferably used in this invention. The spinning method in a rotating liquid is described, for example, in Japanese Patent Application (OPI) No. 165016/81 (corresponding to U.S. Pat. No. 4,523,626 and European Patent No. 39,169) and Japanese Patent Application (OPI) No. 79052/82 (corresponding to U.S. Pat. No. 4,527,614 and European Pat. No. 50,479). Specifically, water is put into a rotating drum, and a water film is formed on the inner wall of the drum by centrifugal force. The molten alloy is jetted into the water film from a spinning nozzle having an orifice diameter of from about 80 to 200 microns (μm) to form a fine wire having a circular cross section. To obtain a uniform continuous fine wire, it is desirable to make the peripheral speed of the rotating drum equal to, or higher than, the speed of the molten metal flow jetted from the spinning nozzle, and particularly preferably higher than the speed of the molten metal flow by from 5 to 30%. Preferably, the angle formed between the molten metal flow jetted from the spinning nozzle and the water film formed on the inner wall of the drum is at least 20°. Further, the fine wire of this invention can be produced by the other methods, for example, Kanesh method as described in U.S. Pat. No. 3,845,805.

The fine wire of this invention generally has a diameter of about from 50 to 250 microns (μm) and a circularity of at least 60% (method of determination described below), preferably at least 80%, and especially preferably at least 90%, and preferably has a uniform shape shown by a diameter variation of not more than 4%.

The fine wire of this invention has low magnetostriction, high magnetic permeability, high saturation magnetic flux density, and excellent toughness, and hardly decreases in magnetic permeability when subjected to a bias magnetic field. For example, a fine amorphous metallic wire composed of $(Co_{0.945}Fe_{0.055})_{72}$—$Si_{12.5}B_{15}Mn_{0.5}$ having a circular cross section and high quality can be bent by 180° bending property and has excellent toughness, a magnetic flux density ($B_{20}$) under the application of a magnetic field of 20 Öe of 7.8 KG, a magnetic permeability ($\mu_{100}$) at a frequency of 100 KHz of as high as 1880, and a magnetostriction of nearly zero. Its Hc is 0.062 Öe, which is higher than the Hc (0.036 Öe) of a conventional fine amorphous metallic wire composed of $(Co_{0.94}Fe_{0.06})_{72.5}Si_{12.5}B_{15}$. Thus, this fine amorphous metallic wire is substantially invulnerable to the influences of a bias magnetic field, and is magnetically stable. However, an amorphous ribbon having the composition $(Co_{0.94}Fe_{0.055})_{72}Si_{12.5}B_{15}Mn_{0.5}$ has approximately the same toughness and $B_{20}$ value as the fine amorphous metallic wire of this invention having the same composition, but has a $\mu_{100}$ of as low as 830 and an Hc value of as low as 0.005 Öe, and therefore is influenced by even a slight bias magnetic field such as the earth's magnetism and decreases greatly in magnetic permeability. For example, when such ribbon is used in a coordinates reading device or the like, signals obtained may sometimes become very small, and its stability to a bias magnetic field is extremely low.

The fine amorphous metallic wire of this invention is stable against a bias magnetic field, and particularly has a $V_H$ value, defined hereinbelow, of not more than 1.5, preferably not more than 1.2, more preferably not more than 0.75, showing better stability than conventional ribbon having a $V_H$ of from 2.1 to 2.6.

The following examples illustrate the present invention more specifically. However, the invention is not limited to these examples.

EXAMPLES 1 TO 15 AND COMPARATIVE EXAMPLES 1 TO 7

In each run, each of Co—Fe—Si—B type alloys and Co—Fe—Si—B—Mn type alloys having the compositions shown in Table 1 was melted in an argon gas atmosphere, and jetted from a quartz glass spinning nozzle having an orifice diameter of 0.13 mm under an argon gas jetting pressure of 4.5 kg/cm$^2$ into a cooling liquid, 25 mm deep, kept at a temperature of 4° C. and formed within a cylindrical drum having an inside diameter of 500 mm and rotating at a speed of 300 rpm to quench and coagulate the molten alloy and to produce a continuous fine amorphous metallic wire having a circular cross section and a diameter of 120 microns (μm).

At this time, the distance between the spinning nozzle and the surface of the rotating cooling liquid was maintained at 3 mm, and the angle formed between the molten metal stream jetted from the spinning nozzle and the surface of the rotating cooling liquid was about 65°.

For comparison, an amorphous alloy ribbon having the composition shown in Table 1 and a flat cross section was produced by jetting out the molten alloy onto a rotating cooling roll composed of copper (Comparative Examples 2, 5, and 6).

The electromagnetic properties, 180° bending property, and shape of the resulting amorphous alloy wire or ribbon were measured, and the results are summarized in Table 1.

The circularity was determined by selecting 10 points in the lengthwise direction of the continuous fine wire, and calculating an average of the ratios $(r/R)\times 100(\%)$) of the long diameters (R) and the short diameters (r) of the cross sections of these points.

The diameter variation was determined by a coefficient of variation of the average wire diameter obtained by causing the fine wire to run 50 m by a laser wire diameter measuring instrument (SLG-104 type, made by Shin Nippon Kagaku Seisakusho Co., Ltd.) and measuring the continuous average wire diameter. That is, its diameter variation means a coefficient of variation of a long diameter in the lengthwise direction which is represented by the formula ($\sigma_n/x\times 100(\%)$), wherein x is an average of the diameters measured at each points in the lengthwise direction of the wire when caused the wire to run 50 m, and $\sigma_n$ is a standard deviation of the measured values at each portion.

The coercivity Hc at a.c. 50 Hz and the magnetic flux density $B_{20}$ at 20 Öe were measured from an a.c. magnetization curve determined by a BH curve tracer made by Riken Electronics Co., Ltd.

The magnetic permeability $\mu$(10 mÖe, 100 KHz) was measured by an impedance analyzer (4192 ALF, made by YHP) on a fine wire or ribbon sample having a length of 40 cm inserted into a coil.

The magnetostriction was measured by using a magnetostriction measuring device made by Naruse Scientific Machine Co., Ltd.

The stability to a bias magnetic field, indicated by the $V_H$ value in Table 1 below, was determined as follows: by using an impedance analyzer, the magnetic permeability $\nu$(100 KHz) of a sample was measured while the bias magnetic field was continuously varied from 0 Öe to 0.4 Öe in the axial direction of the sample. From the bias magnetic field-permeability curve, the variation $V_H$ of the magnetic permeability with respect to the bias magnetic field was calculated in accordance with the equation.

$$V_H = \frac{\log(\mu_{100})_0 - \log(\mu_{100})_{0.4}}{0.4} \cdot (1/\text{Öe})$$

wherein $(\mu_{100})_0$ is the magnetic permeability in the absence of the bias magnetic field and $(\mu_{100})_{0.4}$ is the magnetic permeability under the application of a bias magnetic field of 0.4 Öe.

TABLE 1

| Example No. | Alloy Composition (atomic %) | $\mu_{100}$ | Hc (Oe) | $V_H$ | 180° Bending Property | Shape: Circularity (%) | Shape: Diameter Variation (%) |
|---|---|---|---|---|---|---|---|
| Comp. Ex. 1 | $(Co_{0.94}Fe_{0.06})_{72.5}Si_{12.5}B_{15}$ | 1820 | 0.036 | 2.01 | possible | 96 | 1.3 |
| Ex. 1 | $(Co_{0.94}Fe_{0.06})_{72.35}Si_{12.5}B_{15}Mn_{0.15}$ | 1830 | 0.047 | 0.62 | " | 98 | 1.2 |
| Ex. 2 | $(Co_{0.94}Fe_{0.06})_{72.25}Si_{12.5}B_{15}Mn_{0.25}$ | 1840 | 0.056 | 0.58 | " | 96 | 1.2 |
| Ex. 3 | $(Co_{0.945}Fe_{0.055})_{72}Si_{12.5}B_{15}Mn_{0.5}$ | 1880 | 0.062 | 0.26 | " | 95 | 1.3 |
| Comp. Ex. 2 | $(Co_{0.945}Fe_{0.055})_{72}Si_{12.5}B_{15}Mn_{0.5}$ | 830 | 0.005 | 2.68 | " | 1 | — |
| Comp. Ex. 3 | $(Co_{0.945}Fe_{0.055})_{89.5}Si_5B_5Mn_{0.5}$ | — | — | — | breaks | 93 | 1.4 |
| Ex. 4 | $(Co_{0.945}Fe_{0.055})_{72}Si_{7.5}B_{20}Mn_{0.5}$ | 1840 | 0.068 | 0.31 | possible | 97 | 1.2 |
| Ex. 5 | $(Co_{0.945}Fe_{0.055})_{82}Si_{7.5}B_{10}Mn_{0.5}$ | 1870 | 0.083 | 0.25 | " | 96 | 1.2 |
| Ex. 6 | $(Co_{0.945}Fe_{0.055})_{74.5}Si_{10}B_{15}Mn_{0.5}$ | 1815 | 0.055 | 0.23 | " | 97 | 1.1 |
| Ex. 7 | $(Co_{0.945}Fe_{0.055})_{77}Si_{12.5}B_{10}Mn_{0.5}$ | 1810 | 0.073 | 0.27 | " | 96 | 1.2 |
| Ex. 8 | $(Co_{0.945}Fe_{0.055})_{72}Si_{15}B_{12.5}Mn_{0.5}$ | 1800 | 0.054 | 0.28 | " | 95 | 1.4 |
| Ex. 9 | $(Co_{0.945}Fe_{0.055})_{69.5}Si_{17}B_{12}Mn_{0.5}$ | 1770 | 0.055 | 0.29 | " | 97 | 1.1 |
| Comp. Ex. 4 | $(Co_{0.945}Fe_{0.055})_{71.5}Si_{23}B_5Mn_{0.5}$ | — | — | — | breaks | 92 | 1.3 |
| EX. 10 | $(Co_{0.97}Fe_{0.03})_{71}Si_{12.5}B_{15}Mn_{1.5}$ | 1800 | 0.048 | 0.31 | possible | 95 | 1.4 |
| Ex. 11 | $(Co_{0.925}Fe_{0.075})_{72}Si_{12.5}B_{15}Mn_{0.5}$ | 1700 | 0.088 | 0.31 | " | 98 | 1.0 |
| Ex. 12 | $(Co_{0.945}Fe_{0.055})_{71.75}Si_{12.5}B_{15}Mn_{0.75}$ | 1790 | 0.075 | 0.25 | " | 96 | 1.2 |
| Ex. 13 | $(Co_{0.95}Fe_{0.05})_{71.5}Si_{12.5}B_{15}Mn_{1.0}$ | 1750 | 0.077 | 0.21 | " | 97 | 1.2 |
| Comp. Ex. 5 | $(Co_{0.95}Fe_{0.05})_{71.5}Si_{12.5}B_{15}Mn_{1.0}$ | 660 | 0.004 | 2.54 | " | 1 | — |
| Ex. 14 | $(Co_{0.96}Fe_{0.04})_{70.5}Si_{12.5}B_{15}Mn_{2.0}$ | 1730 | 0.082 | 0.27 | " | 96 | 1.2 |
| Comp. Ex. 6 | $(Co_{0.96}Fe_{0.04})_{70.5}Si_{12.5}B_{15}Mn_{2.0}$ | 720 | 0.004 | 2.35 | " | 1 | — |
| Ex.15 | $(Co_{0.97}Fe_{0.03})_{69.5}Si_{12.5}B_{15}Mn_{3.0}$ | 1720 | 0.098 | 0.29 | " | 97 | 1.0 |
| Comp. Ex. 7 | $(Co_{0.97}Fe_{0.03})_{68.5}Si_{12.5}B_{15}Mn_{4.0}$ | 430 | 0.122 | 0.26 | breaks | 95 | 1.2 |

Table 1 shows that the $V_H$ values of the products obtained in Examples 1 to 15 and Comparative Example 7 are much smaller than those of the products obtained in Comparative Examples 1, 2, 5, and 6. Specifically, the fine amorphous metallic wire of Comparative Example 1 containing no Mn shows a $V_H$ value of as large as 2.01, whereas the fine amorphous metallic wires of Examples 1 to 15 containing Mn have a $V_H$ value of as small as 0.21 to 0.62, about 1/10 of that of the metallic wire of Comparative Example 1. This shows that the fine amorphous metallic wires of Examples 1 to 15 are very stable to a bias magnetic field.

A comparison of Example 3 with Comparative Example 2, Example 13 with Comparative Example 5, and Example 14 with Comparative Example 6 shows that even when the alloy compositions are within the range specified by this invention, the amorphous alloy ribbons have a large $V_H$ value, and the aforesaid stability effect is inherent to the fine metallic wires of this invention. For example, in Comparative Example 1, the ribbon had a magnetic permeability in the absence of a bias magnetic field ($\mu_{100}$) of 1820, but 286 under the application of a bias magnetic field of 0.4 Öe ($\mu_{100}$). In Comparative Example 2, the magnetic permeability of the ribbon was 830 in the absence of a bias magnetic field ($\mu_{100}$), but decreased to 70 under the application of a bias magnetic field of 0.4 Öe $(\mu_{100})_{0.4}$. In contrast, in Example 3, the magnetic permeability in the absence of a bias magnetic field ($\mu_{100}$) was 1880 and decreased only to 1450 even when a bias magnetic field of 0.4 Öe was applied. The decrease was therefore very small.

The wire of Comparative Example 7 showed a small $V_H$ value by the effect of adding Mn, but since its composition was outside the range specified by this invention, it could not be bent by 180° bending property and was very brittle.

In Comparative Examples 3 and 4, the alloys had the compositions outside the scope of this invention, and could not form an amorphous phase even when quenched from the molten state. They crystallized and became brittle and did not show soft magnetism.

While the invention has been described in detail and with reference to specific embodiments thereof, it will be apparent to one skilled in the art that various changes and modifications can be made therein without departing from the spirit and scope thereof.

What is claimed is:

1. A fine magnetic amorphous metal wire having a circular cross section and stability to a bias magnetic field, said wire being composed of an alloy having the composition formula $$(Co_{1-a}Fe_a)_{100-x-y-z}Si_xB_yMn_z$$

wherein $x<20$ atomic%, 7 atomic% $\leqq y<35$ atomic%, 7 atomic% $<x+y\leqq 35$ atomic%, 0.1 atomic% $\leqq z\leqq 3$ atomic%, and $0.01\leqq a\leqq 0.1$.

2. A fine magnetic amorphous metal wire as in claim 1, wherein x is at least 7.5 atomic% but not more than 17.5 atomic%.

3. A fine magnetic amorphous metal wire as in claim 1, wherein z is at least 0.25 atomic% but not more than 2 atomic%.

4. A fine magnetic amorphous metal wire as in claim 1, wherein z is at least 0.4 atomic% but not more than 1.4 atomic%.

5. A fine magnetic amorphous metal wire as in claim 1, wherein $x+y$ is at least 15 atomic% but not more than 32 atomic%.

6. A fine magnetic amorphous metal wire as in claim 1, wherein y is at least 7.5 atomic% but not more than 25 atomic%.

7. A fine magnetic amorphous metal wire as in claim 1, wherein the wire has a circularity of at least 60%.

8. A fine magnetic amorphous metal wire as in claim 1, wherein the wire has a circularity of at least 80%.

9. A fine magnetic amorphous metal wire as in claim 1, wherein the wire has a circularity of at least 90%.

10. A fine magnetic amorphous metal wire as in claim 1, wherein said wire has a $V_H$ value of not more than 1.5.

11. A fine magnetic amorphous metal wire as in claim 1, wherein said wire has a $V_H$ value of not more than 1.2.

12. A fine magnetic amorphous metal wire as in claim 1, wherein said wire has a $V_H$ value of not more than 0.75.

* * * * *